US010327600B1

(12) United States Patent
Schimpf

(10) Patent No.: US 10,327,600 B1
(45) Date of Patent: Jun. 25, 2019

(54) PERSONAL HYGIENE AND WIPING TOOL

(71) Applicant: Adolf Schimpf, Lake Hopatcong, NJ (US)

(72) Inventor: Adolf Schimpf, Lake Hopatcong, NJ (US)

( * ) Notice: Subject to any disclaimer, the term of this patent is extended or adjusted under 35 U.S.C. 154(b) by 370 days.

(21) Appl. No.: 15/391,942

(22) Filed: Dec. 28, 2016

(51) Int. Cl.
*A47K 7/08* (2006.01)
*A47K 7/02* (2006.01)

(52) U.S. Cl.
CPC ..... *A47K 7/08* (2013.01); *A47K 7/028* (2013.01)

(58) Field of Classification Search
CPC . A47K 7/08; A47K 7/028; A47K 7/04; A47K 7/06
See application file for complete search history.

(56) References Cited

U.S. PATENT DOCUMENTS 1,041,173 A * 10/1912 Flagstaff ..... G09F 17/00 116/173
5,823,592 A * 10/1998 Kalidindi ..... B25J 1/04 294/24
6,145,154 A 11/2000 Blair
6,272,716 B1 8/2001 Thornton
6,689,224 B1 2/2004 Hillman
7,249,392 B1 7/2007 Paille
7,698,773 B2 4/2010 Sotelo
8,122,558 B1 2/2012 Maedell
D679,003 S 3/2013 Jupin
8,925,137 B1 1/2015 Munoz
9,648,805 B2 * 5/2017 Nie ..... F16B 7/1418
2004/0237239 A1 12/2004 Savell
2005/0160548 A1 7/2005 Girimont

FOREIGN PATENT DOCUMENTS

GB 2237981 A1 5/1991

* cited by examiner

*Primary Examiner* — Shay Karls
(74) *Attorney, Agent, or Firm* — Kyle A. Fletcher, Esq.

(57) ABSTRACT

The personal hygiene and wiping tool is a cleaning tool. The personal hygiene and wiping tool is adapted for use with a person. The personal hygiene and wiping tool is configured for use with toilet paper. The personal hygiene and wiping tool extends in a telescopic fashion. The personal hygiene and wiping tool is designed to capture and hold in place toilet paper. The personal hygiene and wiping tool is used to extend the reach of the user such that the toilet paper can be brought to hard to reach body locations that may otherwise be difficult to clean adequately. The personal hygiene and wiping tool comprises a first arm and a second arm. The first arm and the second arm are attached in a telescopic manner.

18 Claims, 4 Drawing Sheets

PERSONAL HYGIENE AND WIPING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including sanitary equipment not otherwise provided for, more specifically, a body washing implement having a rigid handle.

SUMMARY OF INVENTION

The personal hygiene and wiping tool is a cleaning tool. The personal hygiene and wiping tool is adapted for use with a person. The personal hygiene and wiping tool is configured for use with toilet paper. The personal hygiene and wiping tool extends in a telescopic fashion. The personal hygiene and wiping tool is designed to capture and hold in place toilet paper. The personal hygiene and wiping tool is used to extend the reach of the user such that the toilet paper can be brought to hard to reach body locations that may otherwise be difficult to clean adequately. The personal hygiene and wiping tool comprises a first arm and a second arm. The first arm and the second arm are attached in a telescopic manner.

These together with additional objects, features and advantages of the personal hygiene and wiping tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the personal hygiene and wiping tool in detail, it is to be understood that the personal hygiene and wiping tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal hygiene and wiping tool.

It is therefore important that the claims be regarded as including such equivalent construction insofar as they do not depart from the spirit and scope of the personal hygiene and wiping tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
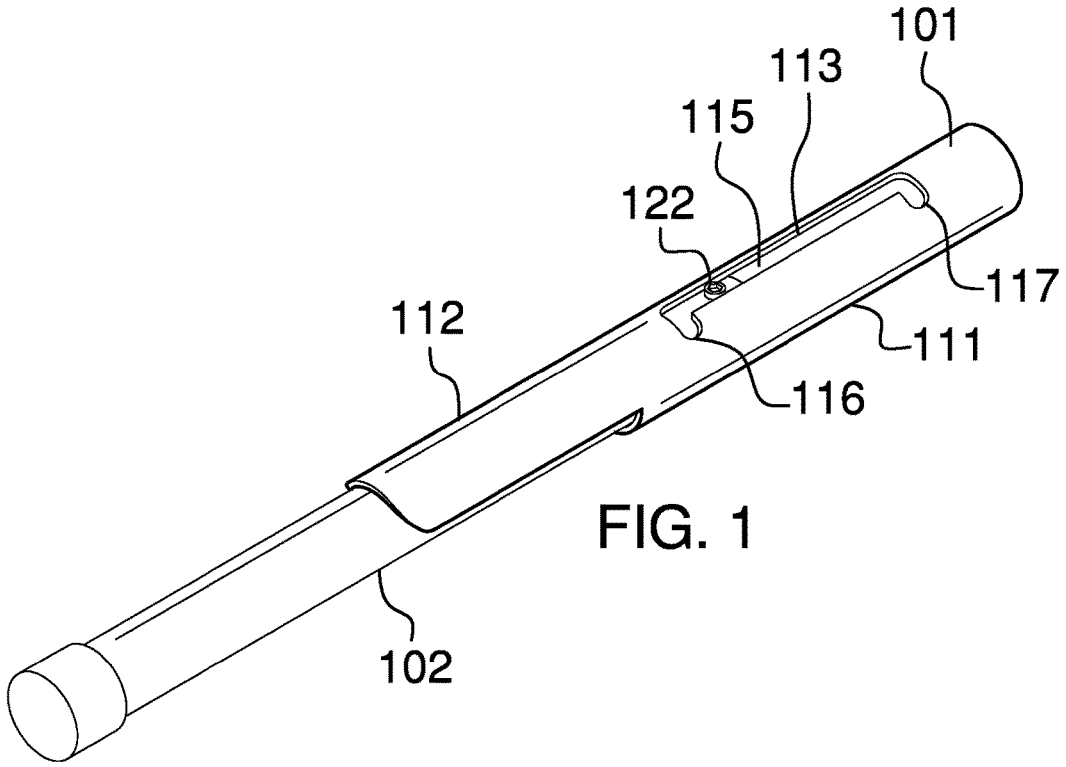
FIG. 1 is an extended perspective view of an embodiment of the disclosure.
Figure 2:
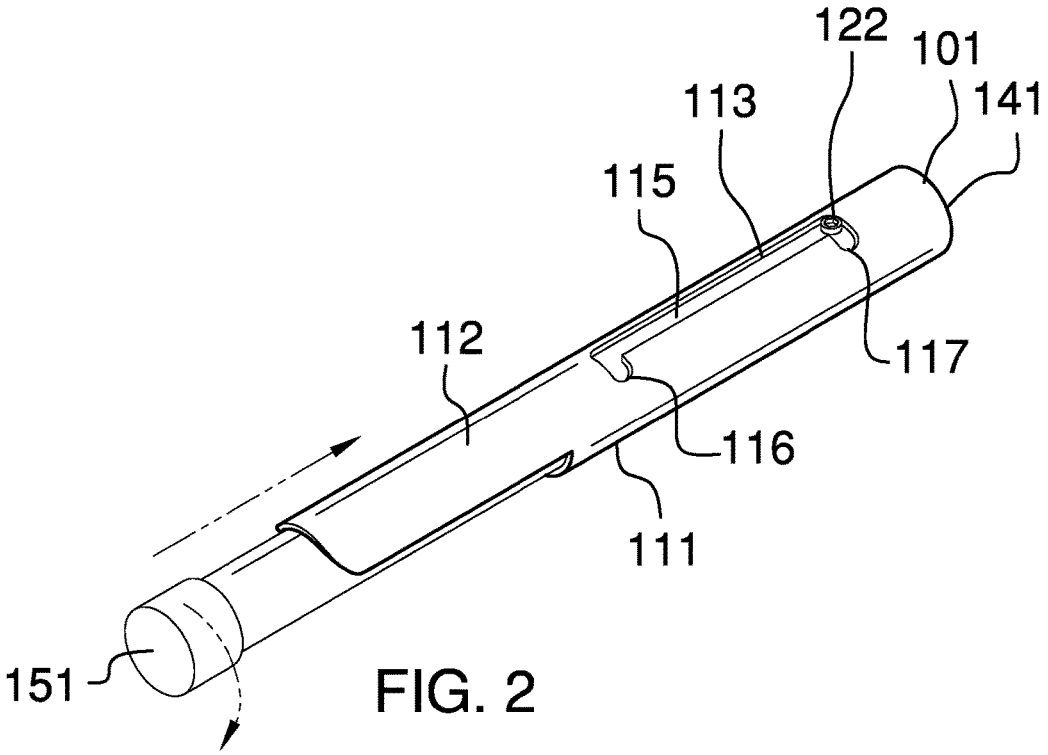
FIG. 2 is a retracted perspective view of an embodiment of the disclosure.
Figure 3:
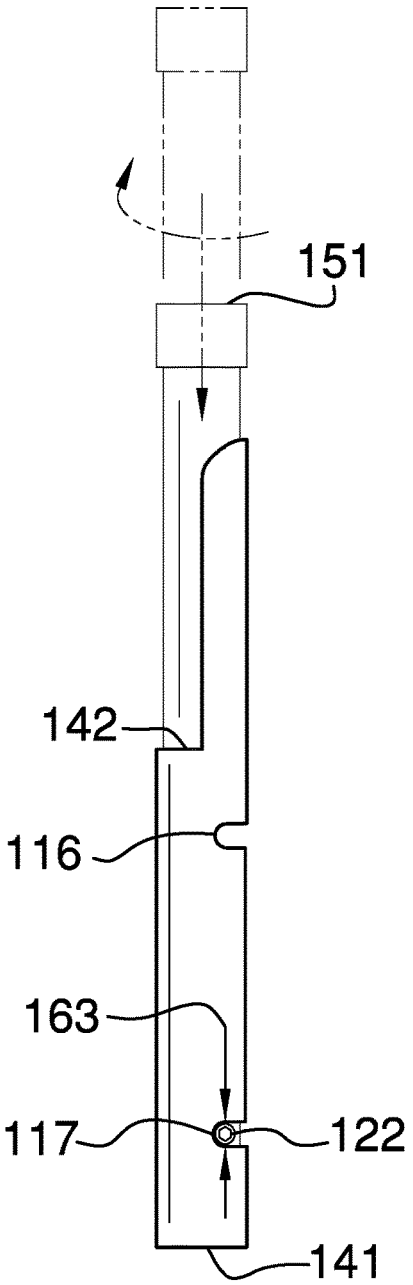
FIG. 3 is a retracted side view of an embodiment of the disclosure.
Figure 4:
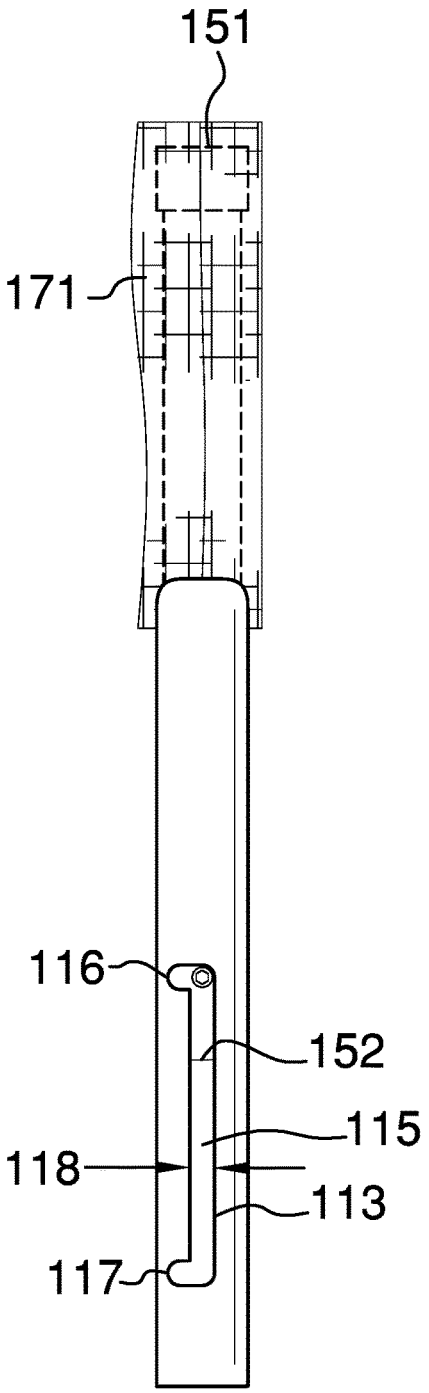
FIG. 4 is an extended side view of an embodiment of the disclosure.
Figure 5:
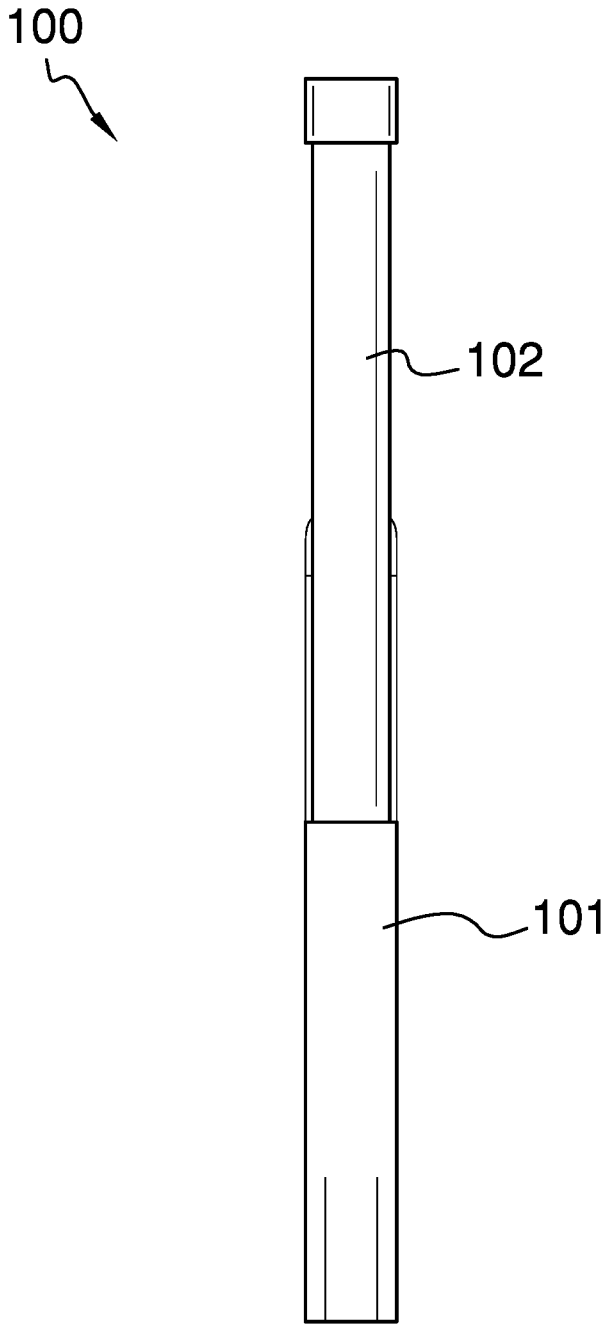
FIG. 5 is an extended alternate side view of an embodiment of the disclosure.
Figure 6:
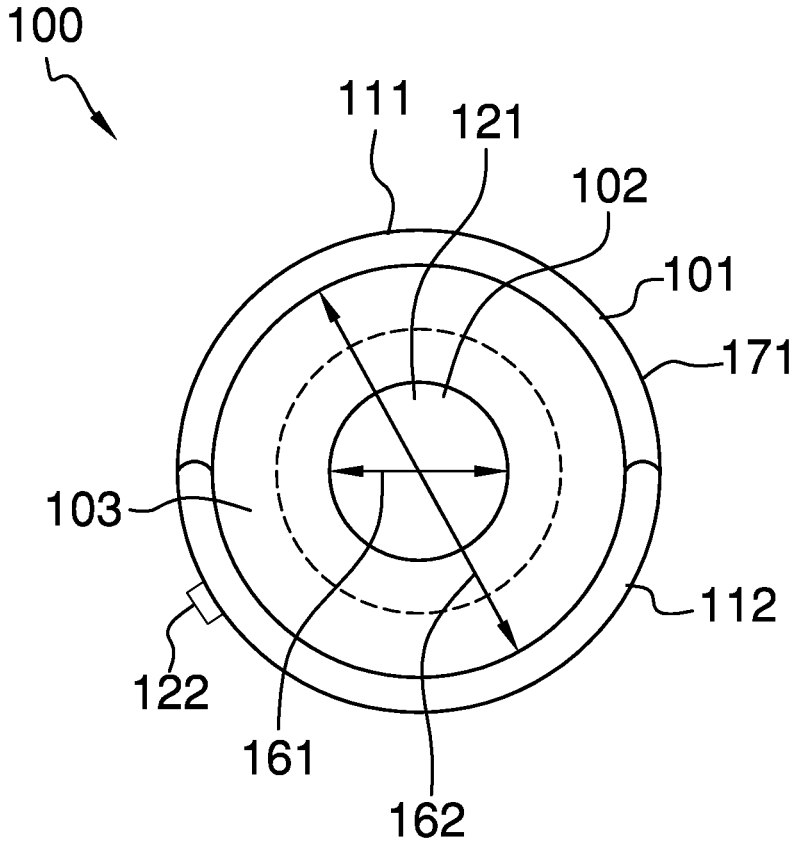
FIG. 6 is an end view of an embodiment of the disclosure.

Detailed reference will now be made to one or more potential embodiments of the disclosure, which are illustrated in FIGS. 1 through 6.

The personal hygiene and wiping tool is a cleaning tool. The invention 100 is adapted for use with a person. The invention 100 is configured for use with toilet paper 171. The toilet paper 171 is an inexpensive pressed paper product that is commonly used for hygiene purposes. The use of toilet paper 171 is well known and documented worldwide. The invention 100 extends in a telescopic fashion. The invention 100 is designed to capture and hold in place toilet paper 171. The invention 100 is used to extend the reach of the user such that the toilet paper 171 can be brought to a hard to reach body location that may otherwise be difficult to clean adequately. The invention 100 comprises a first arm 101 and a second arm 102. The first arm 101 and the second arm 102 are attached to each other in a telescopic manner.

The first arm 101 is a hollow cylindrical structure that is used to form the telescopic structure of the invention 100. The first arm 101 comprises a first base 111, a semi-cylindrical extension 112, and a slide slot 113. The first base 111 is a capped cylindrical pipe that forms the primary structure of the first arm 101. The first base 111 is further defined with a first capped end 141, a first open end 142, and a first inner diameter 162. The first capped end 141 is the closed end of the first base 111. The first open end 142 is the open end of the first base 111. The first inner diameter 162 refers to the inner diameter of the first base 111.

The semi-cylindrical extension 112 is attached to the open end of the first arm 101. The semi-cylindrical extension 112 is a semi-cylindrical pipe that extends away from the first open end 142 of the first arm 101. The semi-cylindrical extension 112 extends away from the first open end 142 such that: 1) the center axis of the cylinder that forms the semi-cylindrical extension 112 is aligned with the center axis of the first base 111; and, 2) the span of the inner diameter of the cylinder that forms the semi-cylindrical extension 112 is identical to the span of the first inner diameter 162 of the first base 111.

The slide slot 113 is an aperture formed through the face of the first base 111. The slide slot 113 forms a structure that: 1) receives a detent 122 from the second arm 102; 2) allows the detent 122 to slide freely within the slide slot 113; and, 3) locks the detent 122 into position such that the position of the second arm 102 can be locked into position relative to the first arm 101. The slide slot 113 comprises a transition slot 115, a first lock notch 116, and a second lock notch 117.

The transition slot 115 is an oval shaped section of the slide slot 113. The sense of direction of the center axis of the transition slot 115 is parallel to the sense of direction of the center axis of the first base 111. The first lock notch 116 is an oval shaped section of the slide slot 113 that projects perpendicularly away from the transition slot 115 such that the center axis of the first lock notch 116 is perpendicular to the center axis of the transition slot 115. The second lock notch 117 is an oval shaped section of the slide slot 113 that projects perpendicularly away from the transition slot 115 such that the center axis of the second lock notch 117 is perpendicular to the center axis of the transition slot 115.

The transition slot 115 is further defined with a slot width 118. The first lock notch 116 is further defined with a slot width 118. The span of the slot width 118 of the first lock notch 116 is the same as the span of the slot width 118 of the transition slot 115. The second lock notch 117 is further defined with a slot width 118. The slot width 118 of the second lock notch 117 is the same as the span of the slot width 118 of the transition slot 115. The slot width 118 is the span of the distance across an oval selected from the group consisting of the transition slot 115, the first lock notch 116, or the second lock notch 117. By across is meant that the slot width 118 is measured along a direction that is perpendicular to the sense of direction of the center axis of the selected oval.

The second arm 102 is a hollow cylindrical structure that is used to form the telescopic structure of the invention 100. The second arm 102 comprises a second base 121 and a detent 122. The second base 121 is a capped cylindrical pipe that forms the primary structure of the second arm 102. The second base 121 is further defined with a second capped end 151, a second open end 152, and a first outer diameter 161. The second capped end 151 is the closed end of the second base 121. The second open end 152 is the open end of the second base 121. The first outer diameter 161 refers to the outer diameter of the second base 121. The detent 122 is a cylindrical post that projects perpendicularly away from the face of the second arm 102. The detent 122 is further defined with a second outer diameter 163. The second outer diameter 163 refers to the outer diameter of the detent 122.

The span of the second outer diameter 163 of the detent 122 is lesser than the slot width 118 of the transition slot 115 such that the detent 122 can slide through the transition slot 115. The span of the second outer diameter 163 of the detent 122 is lesser than the slot width 118 of the first lock notch 116 such that the detent 122 can rotate into and out of the first lock notch 116. The span of the second outer diameter 163 of the detent 122 is lesser than the slot width 118 of the second lock notch 117 such that the detent 122 can rotate into and out of the second lock notch 117.

The invention 100 is assembled by inserting the second open end 152 of the second arm 102 into the first open end 142 of the first arm 101 such that the detent 122 projects through the opening formed by the slide slot 113 in a manner that allows the detent 122 to slide through the slide slot 113.

The span of the first inner diameter 162 of the first arm 101 is greater than the first outer diameter 161 of the second arm 102 such that the second open end 152 of the second arm 102 can be inserted into the first open end 142 of the first arm 101 such that the second arm 102 can slide within the first arm 101.

The span of the length of the invention 100 can be adjusted by adjusting the position of the second arm 102 within the first arm 101 relative to the position of the first arm 101. The length direction of the invention 100 is the direction that is parallel to the center axis of the first arm 101 and the center axis of the second arm 102 when the invention 100 is assembled in the intended manner.

To insert the detent 122 into the first lock notch 116 the position of the second arm 102 is adjusted relative to the position of the first arm 101 such that the center axis of the detent 122 intersects with the center axis of the first lock notch 116. The second arm 102 is then rotated using the center axis of the second arm 102 as the center of rotation such that the detent 122 rotates into the first lock notch 116. To remove the detent 122 from the first lock notch 116 of the slide slot 113 the second arm 102 is rotated in the opposite direction. Inserting the detent 122 into the first lock notch 116 of the slide slot 113 locks the second arm 102 into position relative to the first arm 101.

To insert the detent 122 into the second lock notch 117 the position of the second arm 102 is adjusted relative to the position of the first arm 101 such that the center axis of the detent 122 intersects with the center axis of the second lock notch 117. The second arm 102 is then rotated using the center axis of the second arm 102 as the center of rotation such that the detent 122 rotates into the second lock notch 117. Inserting the detent 122 into the second lock notch 117 of the slide slot 113 locks the second arm 102 into position relative to the first arm 101. To remove the detent 122 from the second lock notch 117 of the slide slot 113 the second arm 102 is rotated in the opposite direction.

To use the invention 100, the second arm 102 is fully extended. Toilet paper 171 is then wrapped around the second arm 102 such that the toilet paper 171 is secured within the interstitial space 103 between the semi-cylindrical extension 112 and the second arm 102. The invention 100 is then used as an extension of the hand to bring the toilet paper 171 to the surface to be cleansed.

The following definitions were used in this disclosure:

Align: As used in this disclosure, align refers to an arrangement of objects that are: 1) arranged in a straight line; or, 2) arranged to give a directional sense of a plurality of parallel lines.

Capped Pipe: As used in this disclosure, a capped pipe is a pipe with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is referred to as an axis of rotation.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Detent: As used in this disclosure, a detent is a device for positioning and holding one mechanical part in relation to another in a manner such that the device can be released by force applied to one or more of the parts.

Diameter: As used in this disclosure, a diameter of an object is a straight-line segment that passes through the center of an object. The line segment of the diameter is terminated at the perimeter or boundary of the object through which the line segment of the diameter runs.

Oval: As used in this disclosure, an oval is a geometric shape that is formed in the shape of a "squished" circle similar in form to an ellipse. The difference between an oval and an ellipse is that an ellipse can be described by a mathematical formula while an oval has no such description.

Pipe: As used in this disclosure, a pipe is a hollow cylindrical device that is used for transporting liquids and gases. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

Semi-Cylinder: As used in this disclosure, a semi-cylinder is half of a cylinder that is divided lengthwise such that the center axis of the cylinder is fully contained within the dividing plane.

Slot: As used in this disclosure, a slot is a long narrow groove or aperture that is formed in or through an object.

Telescopic: As used in this disclosure, telescopic is an adjective that describes an object made of sections that fit or slide into each other such that the object can be made longer or shorter by adjusting the relative positions of the sections.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An sanitary apparatus comprising
a first arm and a second arm;
wherein the sanitary apparatus is a cleaning tool;
wherein the first arm and the second arm are attached to each other in a telescopic manner;
wherein the sanitary apparatus is adapted for use with a person;
wherein the sanitary apparatus is configured for use with toilet paper;
wherein the sanitary apparatus extends in a telescopic fashion;
wherein the sanitary apparatus is designed to capture and hold in place toilet paper;
wherein the first arm comprises a first base;
wherein the first base is a capped cylindrical pipe;
wherein the first base is further defined with a first capped end, a first open end, and a first inner diameter;
wherein the first arm further comprises a semi-cylindrical extension;
wherein the semi-cylindrical extension is attached to the open end of the first arm;
wherein the semi-cylindrical extension is a semi-cylindrical pipe that extends away from the first open end of the first arm.

2. The sanitary apparatus according to claim 1 wherein the semi-cylindrical extension extends away from the first open end such that the center axis of the cylinder that forms the semi-cylindrical extension is aligned with the center axis of the first base.

3. The sanitary apparatus according to claim 2 wherein the semi-cylindrical extension extends away from the first open end such that the span of the inner diameter of the cylinder that forms the semi-cylindrical extension is identical to the span of the first inner diameter of the first base.

4. The sanitary apparatus according to claim 3
wherein the first arm further a slide slot;
wherein the slide slot is an aperture formed through the face of the first base.

5. The sanitary apparatus according to claim 4
wherein the slide slot forms a structure that receives a detent from the second arm;
wherein the slide slot allows the detent to slide freely within the slide slot;
wherein the slide slot locks the detent into position such that the position of the second arm can be locked into position relative to the first arm.

6. The sanitary apparatus according to claim 5
wherein the slide slot comprises a transition slot, a first lock notch, and a second lock notch;
wherein the first lock notch projects away from the transition slot;
wherein the second lock notch projects away from the transition slot.

7. The sanitary apparatus according to claim 6
wherein the transition slot is an oval shaped structure;
wherein the sense of direction of the center axis of the transition slot is parallel to the sense of direction of the center axis of the first base.

8. The sanitary apparatus according to claim 7 wherein the first lock notch is an oval shaped section of the slide slot that projects perpendicularly away from the transition slot such that the center axis of the first lock notch is perpendicular to the center axis of the transition slot.

9. The sanitary apparatus according to claim 8 wherein the second lock notch is an oval shaped section of the slide slot that projects perpendicularly away from the transition slot such that the center axis of the second lock notch is perpendicular to the center axis of the transition slot.

10. The sanitary apparatus according to claim 9 wherein the transition slot is further defined with a first slot width;

wherein the first lock notch is further defined with a second slot width;

wherein the span of the second slot width is the same as the span of the first slot width of the transition slot;

wherein the second lock notch is further defined with a third slot width;

wherein the span of the third slot width is the same as the span of the first slot width.

11. The sanitary apparatus according to claim 10 wherein a slot width is the span of the distance across an oval selected from the group consisting of the transition slot, the first lock notch, or the second lock notch;

wherein by across is meant that the slot width is measured along a direction that is perpendicular to the sense of direction of the center axis of the selected oval.

12. The sanitary apparatus according to claim 11 wherein the second arm comprises a second base;

wherein the second base is a capped cylindrical pipe that forms the primary structure of the second arm;

wherein the second base is further defined with a second capped end, a second open end, and a first outer diameter;

wherein the second capped end is the closed end of the second base;

wherein the second open end is the open end of the second base.

13. The sanitary apparatus according to claim 12 wherein the second arm further comprises the detent;

wherein the detent is a cylindrical post that projects perpendicularly away from the face of the second arm;

wherein the detent is further defined with a second outer diameter.

14. The sanitary apparatus according to claim 13 wherein the span of the second outer diameter of the detent is lesser than the slot width of the transition slot such that the detent can slide through the transition slot;

wherein the span of the second outer diameter of the detent is lesser than the slot width of the first lock notch such that the detent can rotate into and out of the first lock notch;

wherein the span of the second outer diameter of the detent is lesser than the slot width of the second lock notch such that the detent can rotate into and out of the second lock notch.

15. The sanitary apparatus according to claim 14 wherein the span of the first inner diameter of the first arm is greater than the first outer diameter of the second arm;

wherein the second open end of the second arm inserts into the first open end of the first arm such that the second arm can slide within the first arm;

wherein the second open end of the second arm inserts into the first open end of the first arm such that the detent projects through the opening formed by the slide slot in a manner that allows the detent to slide through the slide slot.

16. The sanitary apparatus according to claim 15 wherein to insert the detent into the first lock notch the position of the second arm is adjusted relative to the position of the first arm such that the center axis of the detent intersects with the center axis of the first lock notch;

wherein the second arm rotates using the center axis of the second arm as the center of rotation such that the detent rotates into the first lock notch;

wherein inserting the detent into the first lock notch of the slide slot locks the second arm into position relative to the first arm;

wherein to insert the detent into the second lock notch the position of the second arm is adjusted relative to the position of the first arm such that the center axis of the detent intersects with the center axis of the second lock notch;

wherein the second arm rotates using the center axis of the second arm as the center of rotation such that the detent rotates into the second lock notch;

wherein inserting the detent into the second lock notch of the slide slot locks the second arm into position relative to the first arm.

17. The sanitary apparatus according to claim 16 wherein the span of the length of the sanitary apparatus is adjusted by adjusting the position of the second arm within the first arm relative to the position of the first arm.

18. The sanitary apparatus according to claim 17 wherein toilet paper is wrapped around the second arm such that the toilet paper is secured within the interstitial space between the semi-cylindrical extension and the second arm.

* * * * *